US006923747B1

(12) United States Patent
Chu

(10) Patent No.: US 6,923,747 B1
(45) Date of Patent: Aug. 2, 2005

(54) FOLDABLE TREADMILL

(75) Inventor: Yong S. Chu, Glendale, CA (US)

(73) Assignee: Chi-Hsin IMPEX, Inc., City of Industry, CA (US)

( * ) Notice: Subject to any disclaimer, the term of this patent is extended or adjusted under 35 U.S.C. 154(b) by 0 days.

(21) Appl. No.: 10/802,557

(22) Filed: Mar. 17, 2004

(51) Int. Cl.[7] ..... A63B 22/02
(52) U.S. Cl. ..... 482/54
(58) Field of Search ..... 482/51, 54, 148

(56) References Cited

U.S. PATENT DOCUMENTS

| | | | | | |
|---|---|---|---|---|---|
| 931,344 | A | * | 8/1909 | Roberts | 177/80 |
| 2,017,128 | A | * | 10/1935 | O'Neill, Jr. | 482/54 |
| 4,776,582 | A | | 10/1988 | Ramhorst | 272/69 |
| 5,100,127 | A | | 3/1992 | Melnick et al. | 119/29 |
| 5,558,604 | A | | 9/1996 | Hopkins | 482/54 |
| 5,662,557 | A | | 9/1997 | Watterson et al. | 482/54 |
| 5,669,857 | A | | 9/1997 | Watterson et al. | 482/54 |
| 5,672,140 | A | | 9/1997 | Watterson et al. | 482/54 |
| 5,674,156 | A | | 10/1997 | Watterson et al. | 482/54 |
| 5,674,453 | A | | 10/1997 | Watterson et al. | 482/54 |
| 5,676,624 | A | | 10/1997 | Watterson et al. | 482/54 |
| 5,743,835 | A | | 4/1998 | Trotter | 482/57 |
| 5,772,560 | A | | 6/1998 | Watterson et al. | 482/54 |
| 5,899,834 | A | | 5/1999 | Dalebout et al. | 482/54 |
| 5,993,358 | A | | 11/1999 | Gureghian et al. | 482/54 |
| 6,033,347 | A | | 3/2000 | Dalebout et al. | 482/54 |
| 6,077,200 | A | * | 6/2000 | Lin | 482/54 |
| 6,350,218 | B1 | | 2/2002 | Dalebout et al. | 482/54 |
| 6,471,622 | B1 | | 10/2002 | Hammer et al. | 482/54 |
| 6,682,460 | B2 | * | 1/2004 | Lo et al. | 482/54 |
| 2002/0151413 | A1 | | 10/2002 | Dalebout et al. | 482/54 |

FOREIGN PATENT DOCUMENTS

| | | |
|---|---|---|
| TW | 498767 | 11/2002 |

* cited by examiner

*Primary Examiner*—Stephen R. Crow
(74) *Attorney, Agent, or Firm*—Sheppard, Mullin, Richter & Hampton LLP

(57) ABSTRACT

A foldable treadmill is provided that can be easily reoriented for variable exercise inclinations, as well as, for convenient storage. The treadmill includes a tread assembly and an A-frame assembly positioned about the front end of the tread assembly. The A-frame assembly includes an inclination support connected to a front end of the tread assembly by hinges for varying inclination of the tread assembly. The inclination support can be driven by a motor to rotate the inclination support about such that the inclination support vertically displaces the front end of the tread assembly thereby varying the inclination of the tread assembly. The A-frame assembly includes intermediate and front supports hinged to each other at upper ends thereof. The tread assembly is rotatable to a generally vertical orientation for storage. In the stored position, the spacing between front and intermediate supports is reduced, further facilitating storage. The A-frame assembly can further include a handle assembly having upper portion having handles and a lower portion in motive relation to the tread assembly such that variation in inclination corresponds to vertical displacement of the handle assembly.

22 Claims, 7 Drawing Sheets

FOLDABLE TREADMILL

BACKGROUND OF THE INVENTION

The present invention relates generally to treadmills and, more particularly, to treadmills configured to be folded for storage.

Treadmills have long been a convenient and popular means for exercise. Treadmills typically comprise a motorized, endless belt extended between lateral rollers to provide an exercise surface. The exercise surface must be of sufficient length to accommodate running strides. Thus, such treadmills can take up a relatively substantial amount of floor space, which can be a concern and limit usefulness, particularly as a home exercise alternative.

More recently, treadmills that can be folded for storage have been used. Such foldable treadmills commonly include a freestanding base and a tread assembly that can be reoriented vertically when not in use. Although current treadmills are generally effective, shortfalls exist. For example, the base typically has a fixed footprint on the floor relatively long lateral foot supports for stability. Thus, storage can still be an issue. Also, current approaches for foldable treadmills are limited in maximum inclination of running platform, limiting its effectiveness. A control panel for initiating and monitoring exercise is commonly provided at the front of the treadmill; however, access and visibility of the control panel can be hampered as inclination is varied.

It should, therefore, be appreciated that there exists a need for a foldable treadmill that has a variable footprint, provides high inclination, and is easy to use. The present invention fulfills this and other needs.

SUMMARY OF THE INVENTION

The present invention resides in a foldable treadmill having a tread assembly and an A-frame assembly positioned about the front end of the tread assembly. The treadmill can be easily reoriented for variable exercise inclinations, as well as, for convenient storage. The A-frame assembly includes an inclination support connected to a front end of the tread assembly by hinges for varying inclination of the tread assembly. The inclination support can be driven by a motor to rotate the inclination support about such that the inclination support vertically displaces the front end of the tread assembly thereby varying the inclination of the tread assembly. The A-frame assembly includes intermediate and front supports operatively hinged to each other. The tread assembly is rotatable to a generally vertical orientation for storage. In the stored position, the spacing between front and intermediate supports is reduced, further facilitating storage.

In an exemplary embodiment, the intermediate support includes two upstanding legs, each disposed on a corresponding longitudinal side of the tread assembly. The front support includes two upstanding legs spaced apart from one another and a reinforcement extending therebetween. The legs of the supports are generally aligned with each other. The A-frame assembly further includes an intermediate constraint configured to restrict excess horizontal movement of the one of the supports. The A-frame assembly can further include a handle assembly in motive relation to the tread assembly such that variation in inclination corresponds to vertical displacement of the handle assembly.

In another detailed aspect of an exemplary embodiment, the handle assembly further includes a user console. A lower portion of the handle assembly is attached to the inclination support.

In a detailed aspect of an exemplary embodiment, the A-frame assembly further includes a vertical constraint extending between upper ends of the front and intermediate supports. The vertical constraint is configured to restrict relative vertical displacement of the upper ends of the front and intermediate supports such that the both upper ends vertically displace about the same distance during a reorientation of the tread assembly.

In another exemplary embodiment, the front support of the A-frame assembly defines at least one elongated aperture for receiving a handle assembly. The handle assembly is preferably configured to vary its height, as inclination of the tread assembly varies. More particularly, the A-frame assembly can further include a link in motive contact with the handle assembly such that movement caused by the motor will vertically displace the handle assembly. The front support can include two upstanding legs spaced apart from one another and a reinforcement extending therebetween. Each leg defines an elongated aperture for receiving corresponding legs of the handle assembly.

In a detailed aspect of an exemplary embodiment, the intermediate support includes two upstanding legs disposed on corresponding longitudinal sides of the tread assembly. The A-frame can also include two intermediate constraints; each slidably attached to a corresponding leg of the intermediate support and attached to the corresponding longitudinal side of the tread assembly.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
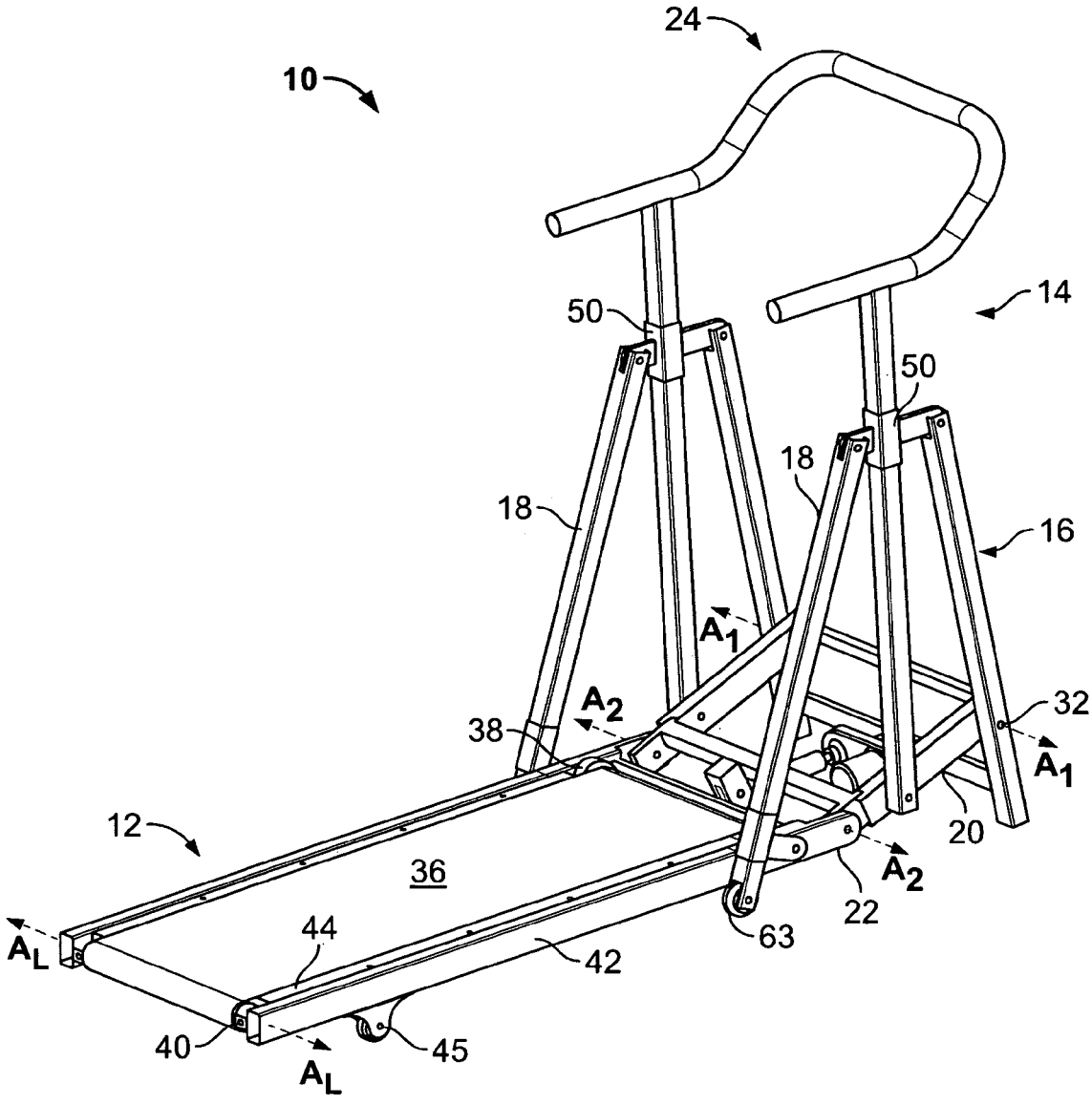
FIG. 1 is a perspective view of a foldable treadmill in accordance with the invention, depicting the treadmill in a generally level orientation.
Figure 4:
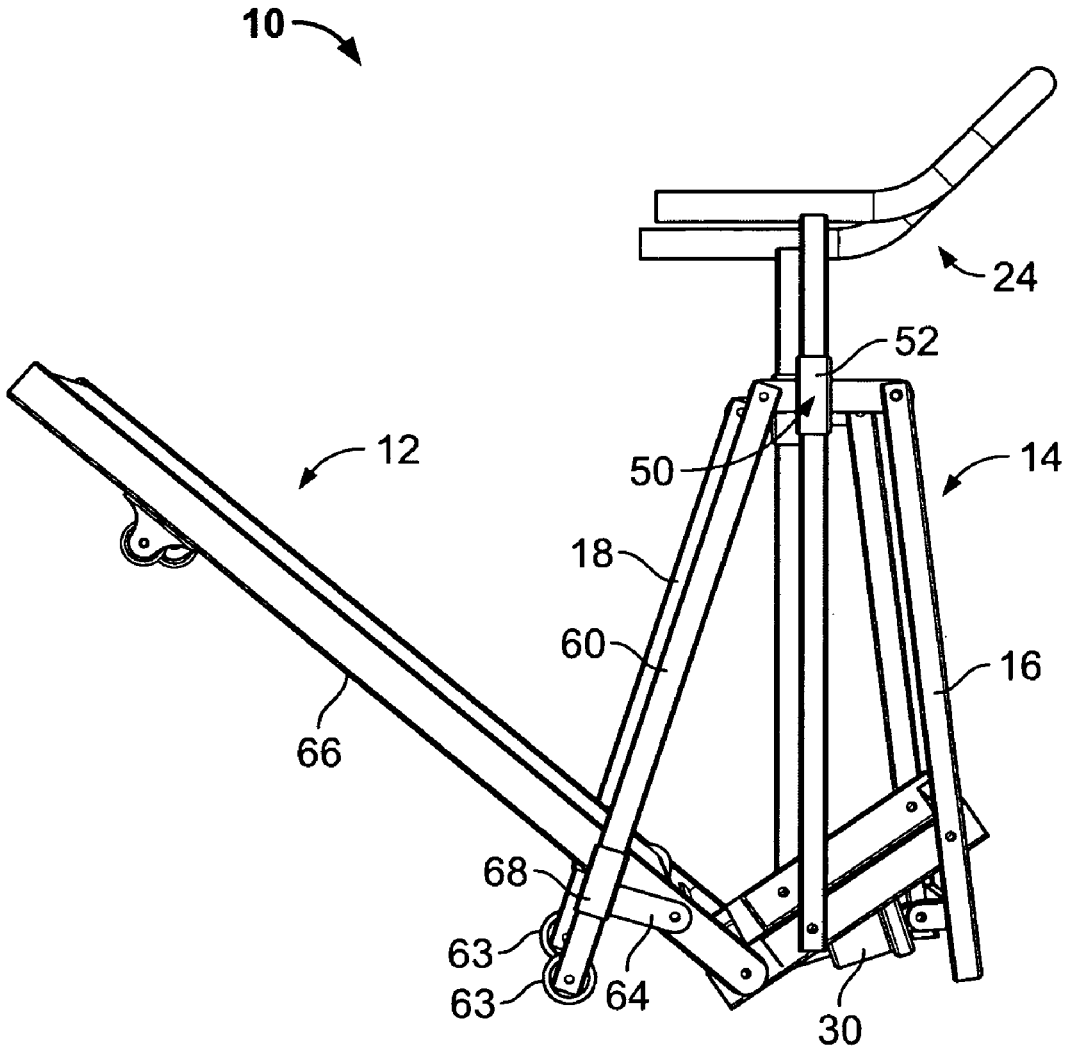
FIG. 4 is a side perspective view of the treadmill of FIG. 1, depicting the treadmill in a partially folded orientation.
Figure 5:
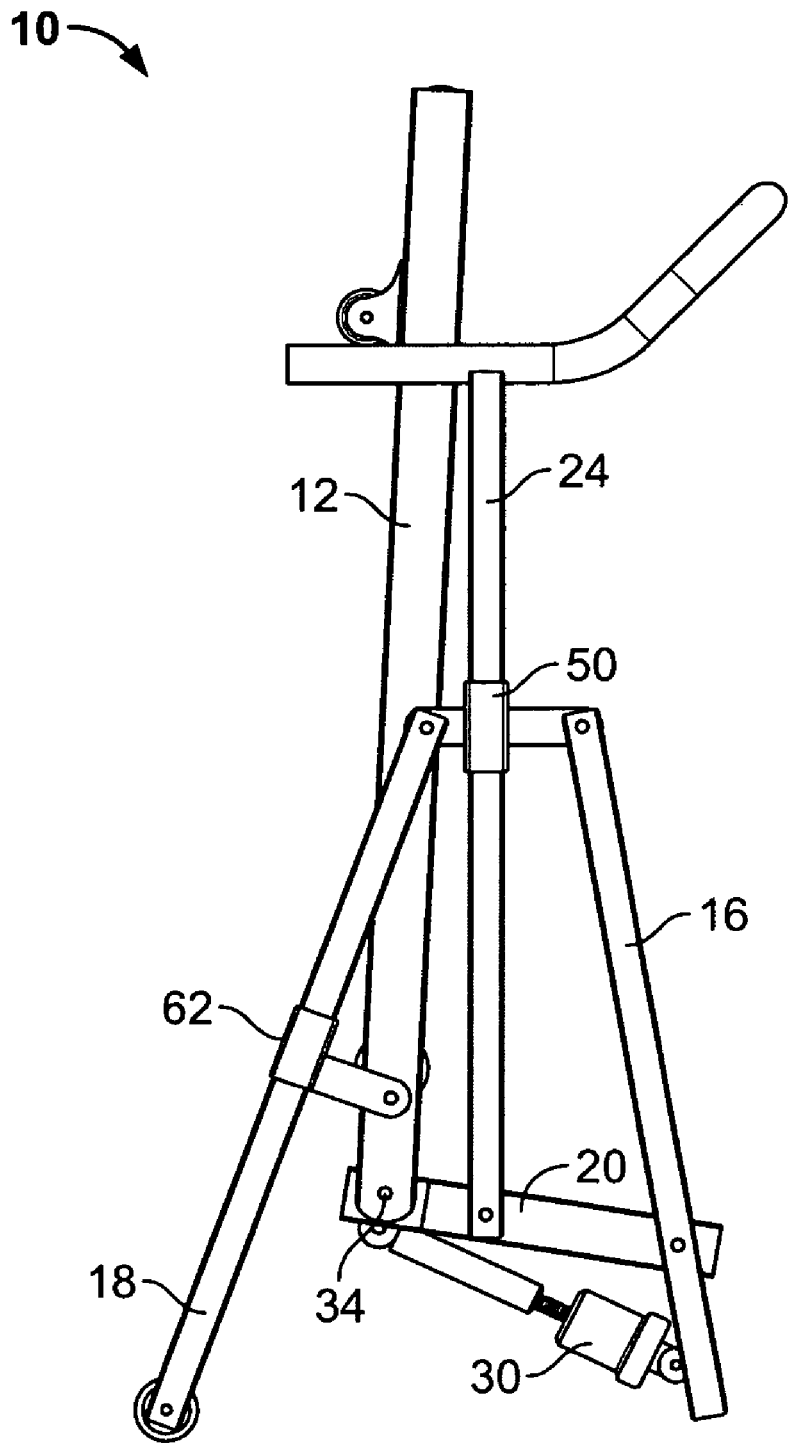
FIG. 5 is a side elevational view of the treadmill of FIG. 1, depicting the treadmill in a fully folded orientation.
Figure 6:
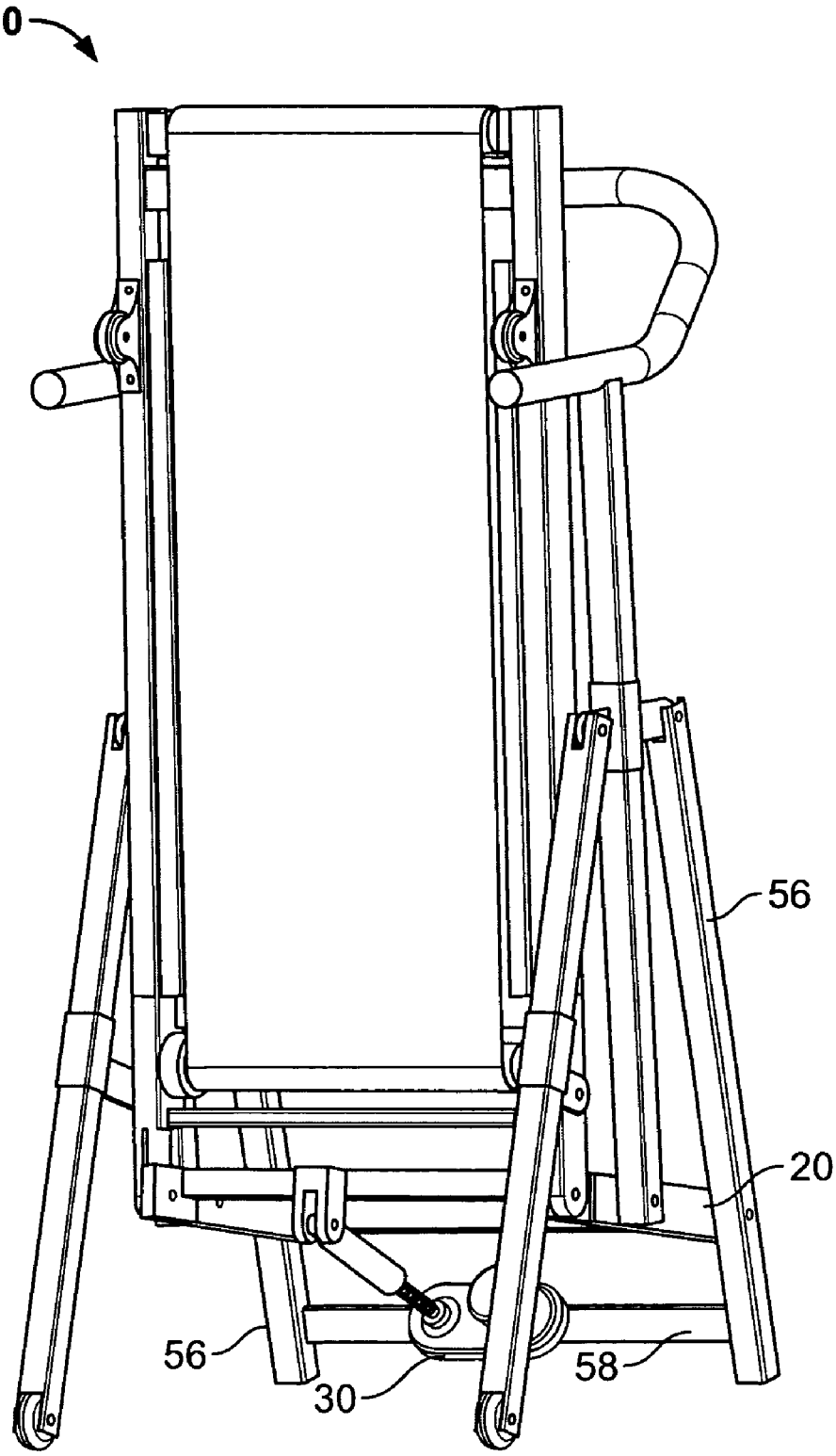
FIG. 6 is a rear perspective view of the treadmill of FIG. 1, depicting the treadmill in a fully folded orientation.

With reference to the illustrative drawings, and particularly to FIG. 1, a treadmill 10 is shown having a tread assembly 12 and an upstanding A-frame assembly 14 positioned about the tread assembly. The A-frame assembly includes front and intermediate supports 16, 18, respectively, and an inclination support 20. The inclination support is connected to a front end 22 of the tread assembly to vary inclination of the tread assembly, to include declination. As depicted in the figures, the treadmill can be easily reoriented for variable exercise inclinations (FIGS. 1–3), as well as, for convenient storage (FIGS. 4–6). The ground footprint area of the A-frame varies throughout the treadmill's range of motion. The tread assembly is rotatable to a generally vertical orientation for storage. In the stored position (FIG. 5), the A-frame's ground footprint is reduced, further facilitating storage. The A-frame assembly further includes a handle assembly 24 attached to the inclination support that raises and lowers along with variation of the tread assembly's inclination, maintaining convenient positioning with respect to the user.

Figure 2:
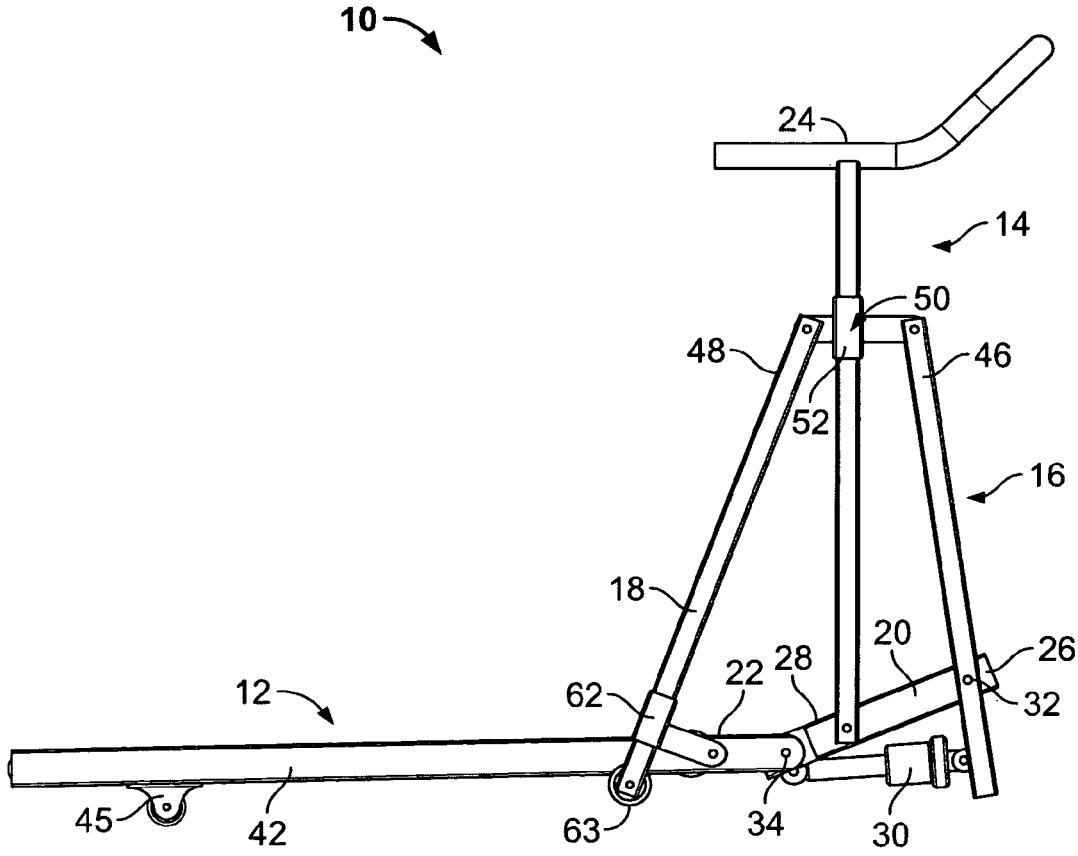
FIG. 2 is a side elevational view of a foldable treadmill of FIG. 1.
Figure 3:
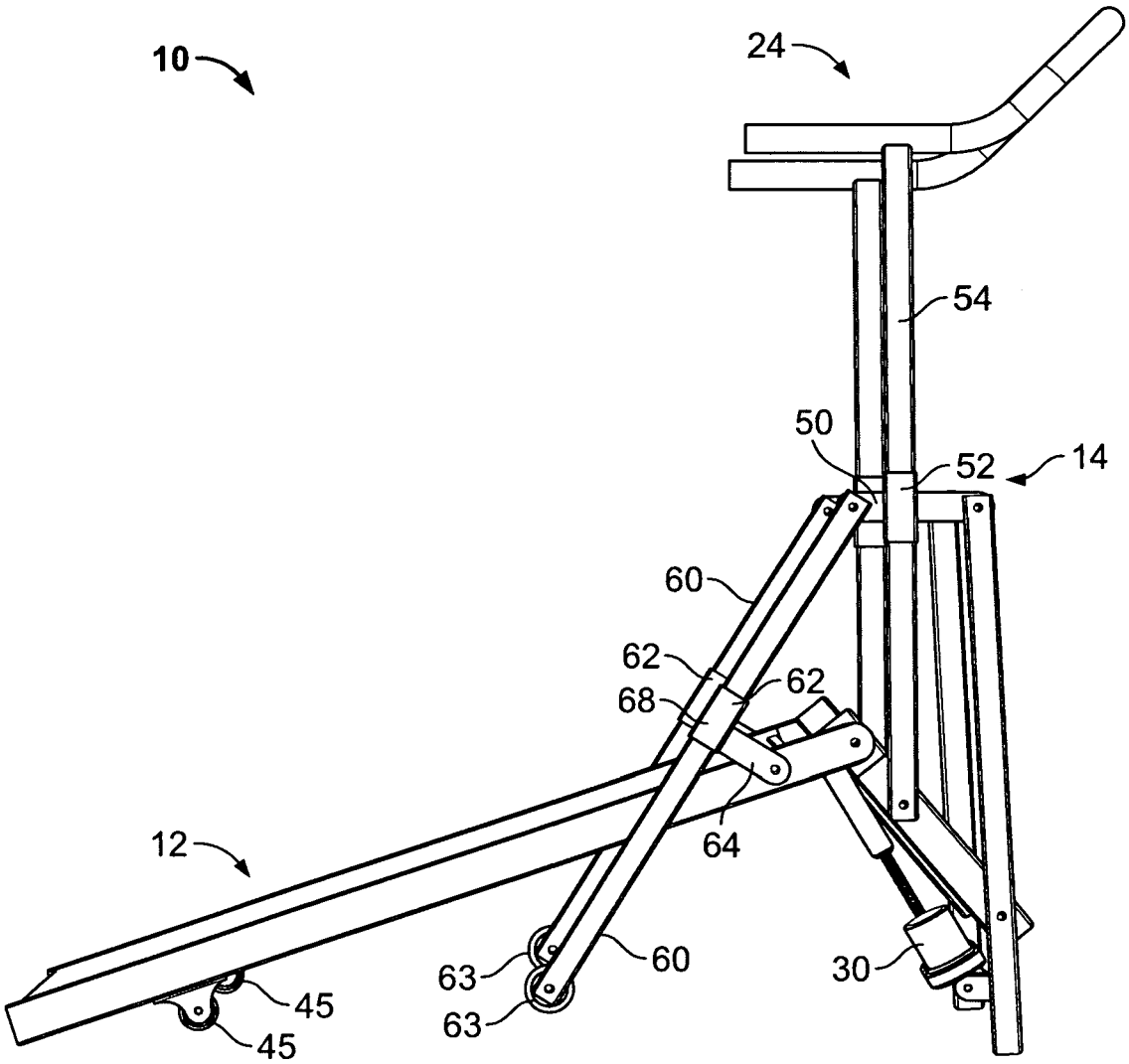
FIG. 3 is a side perspective view of the treadmill of FIG. 1, depicting the treadmill in a fully inclined orientation.

With continued reference to FIGS. 1–3, the inclination support 20 includes a first end 26 hinged with respect to the front support 16, thereby defining a first axis of rotation ($A_1$) generally parallel with a lateral axis ($A_L$) of the tread assembly. The inclination support further includes a second end 28 hinged to the front end of the tread assembly, such that a second axis of rotation ($A_2$) is generally parallel with the lateral axis of the tread assembly. The inclination support is driven by a motor 30. In the exemplary embodiment, a screw jack motor is used; however, other motors can be used. As the motor varies the orientation of the inclination support, the inclination of the tread assembly also changes. More particularly, the inclination support rotates about the first axis of rotation ($A_1$) such that the second end of the inclination support vertically displaces the front end of the tread assembly thereby varying the inclination of the tread assembly. In the exemplary embodiment, the first end of the inclination support is fixed directly to the front support of the A-frame assembly 14 via pivots 32. In other embodiments, the inclination support can be spaced therefrom. For example, the inclination support and the inclination motor can be fixed to a location disposed between the front and intermediate supports, 16, 18.

As best seen in FIGS. 2 and 3, the handle assembly 24 is attached to the inclination support 20 proximate to hinges 34 such that the handle assembly will raise and lower along with the inclination support and the tread assembly 12. The handle assembly may further include a programming/display console (not shown), allowing the user to input an exercise profile and monitor progress throughout the exercise. Thus, the console and handles are conveniently located by the user throughout the range of inclination. Beneficially, the positioning of the console will adjust along with variation in inclination for easy access and viewing.

The user can vary inclination and speed automatically or manually, as desired by the user's exercise profile. The tread assembly includes an endless belt 36 extending between front and rear rollers 38, 40, respectively. The belt can be driven by a belt motor (not shown), as known in the art, to control the running speed of the belt. The rollers are mounted to a frame assembly 42 of the tread assembly 12. A board 44 is positioned between the rollers and is supported by the frame such that the belt revolves about the board. In an exemplary embodiment, the belt motor can be mounted to the inclination support 20 and enclosed in a housing (not shown). The tread assembly includes wheels 45 attached to the frame for support and to facilitate inclination. In other embodiments, wheels can be attached at various other locations, such as to the bottom of the front support, with feet disposed under the frame of the tread assembly.

The A-frame assembly 14 to provides stable support throughout the treadmill's range of motion. The front and intermediate supports, 16, 18 of the A-frame assembly are attached at upper ends 46, 48 thereof by vertical constraints 50. The vertical constraints serve restrict relative vertical displacement of the upper ends of the front and intermediate supports. This enables both upper ends to vertically displace about the same distance during a reorientation of the tread assembly, thereby aiding movement and stability. In the exemplary embodiment, the vertical constraints include sleeves 52 slidably mounted to vertical bars 54 of the handle assembly 24. In other embodiments, the upper ends can interlock, or otherwise coincide about a common pivot point on the sleeves. The front support includes two upstanding legs 56 spaced apart by a lateral bar 58 extending therebetween. The legs of the front support have a generally flat lower end to provide stable contact with the support surface. In this embodiment, the motor 30 is attached to the lateral bar of the front support and to the inclination support 20, adjacent to the hinges 34 connecting the inclination support and the tread assembly 12.

The intermediate support 18 includes two legs 60, each disposed on a corresponding longitudinal side of the tread assembly and slidably attached to the tread assembly by an intermediate constraint 62. Lower ends of the intermediate supports include wheels 63 to facilitate movement along the support surface, as the tread assembly is reoriented. The intermediate constraints facilitate variable positioning of the intermediate support while inhibiting excessive horizontal displacement of the intermediate support with respect to the front support 16. In this embodiment, each intermediate constraint includes an arm 64 pivotally attached to a longitudinal side 66 of the tread assembly 12 and a sleeve 68 disposed about the corresponding leg 60 of the intermediate support. As the tread assembly varies inclination, the sleeves of the intermediate constraints slide along the legs of the intermediate support, causing the footprint of the A-frame assembly 14 to vary. As the tread assembly of the treadmill is rotated about the hinges 34 to a vertical orientation (FIG. 5), the footprint of the A-frame assembly is reduced, further facilitating storage.

With reference again to FIGS. 1–3, the treadmill 10 provides variable inclination during use. In the exemplary embodiment, the treadmill has an inclination range of −3 degrees to 20 degrees. As previously discussed, the motor 30 varies inclination by driving the inclination support 20, which in turn varies the inclination of the tread assembly 12. The user can command the motor via the programming/control console (not shown). Based on the user's input, the console can command the motor to position the tread assembly in a prescribed inclination. Throughout the treadmill's inclination range, floor contact is maintained by the front and intermediate supports 16, 18 of the A-frame assembly and the wheels 45 of the tread assembly, thereby providing stable support during exercise.

With reference now to FIGS. 4–6, the treadmill 10 can be conveniently folded for storage. To store, the tread assembly 12 is lifted from its rear end, causing it to rotate about hinges 34. FIG. 4 depicts storing the tread assembly with the inclination support 20 declined. Nonetheless, the tread assembly can be lifted to a stored position from various inclinations. As depicted in FIGS. 5–6, the tread assembly can be stored in a vertical orientation. The tread assembly can also be safely stored beyond vertical, if desired. In the stored position, floor contact is maintained by the front and intermediate supports 16, 18. In the exemplary embodiment, the tread assembly is lifted manually; however, a motor can be attached at an operable location, for example, between the front end of tread assembly and the front support 18 to automate the process. In such embodiments, the programming/control console could be configured to command stowing of the tread assembly.

Figure 7:
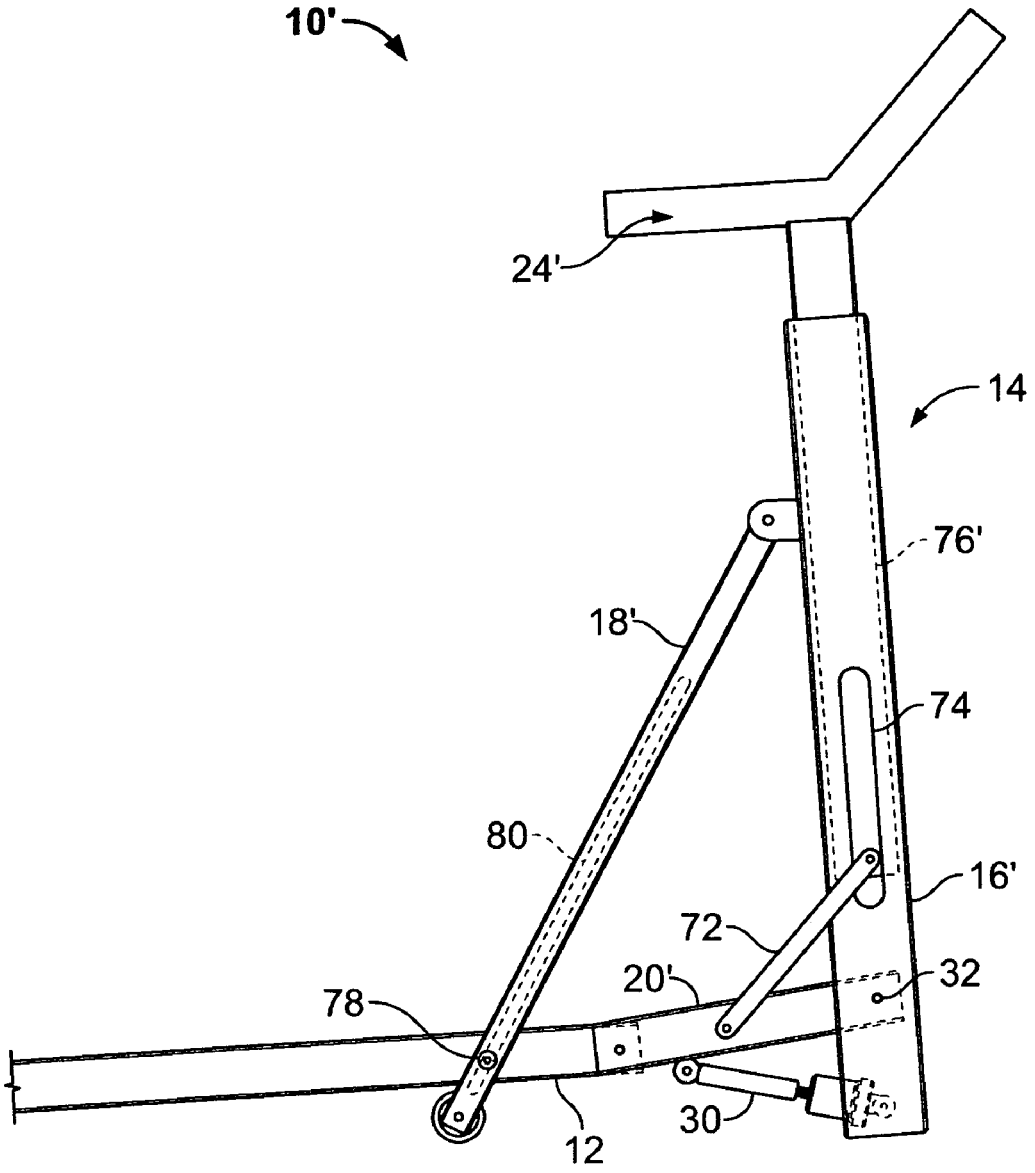
FIG. 7 is a side elevational view of another embodiment of a treadmill in accordance with the invention.

With reference now to FIG. 7, a second embodiment of a treadmill 10' is shown having an A-frame assembly 14' and a tread assembly 12 in accordance with the invention. The A-frame assembly includes a handle assembly 24' disposed in a recess 70 of a front support 16'. The handle assembly is in motive contact with the inclination support 20' via links 72. The links extend through slots 74 defined in the front support and are attached to a lower end 76 of the handle assembly. Thus, as the motor 30 varies the inclination of the tread assembly, the handle assembly will displace vertically. In the exemplary embodiment, the link is attached to the inclination support. However, the links also can be attached at various other locations such that movement caused by the motor 30 will vertically displace the handle assembly. For example, the link could be attached to the front end 38 of the tread assembly.

The A-frame 14' further includes intermediate constraints, i.e., pins 78, provided on opposing longitudinal sides 66 of the tread assembly 12. The pins are configured to restrict excess horizontal movement of the legs 60' of the intermediate support. In this embodiment, each pin has a first portion attached to a corresponding longitudinal side of the tread assembly, from which a second portion extends and is disposed in a corresponding slot 80 defined in the legs of the intermediate support. As the tread assembly varies inclination, the pin slides along the slot, causing the footprint of the A-frame assembly 14' to vary. Moreover, as the tread assembly is rotated about the hinges 34' to a vertical orientation (e.g., FIG. 5), the footprint of the A-frame assembly is reduced, further facilitating storage.

It should be appreciated from the foregoing that the present invention provides a foldable treadmill that can be easily reoriented for variable exercise inclinations, as well as, for convenient storage. The treadmill includes a tread assembly and an A-frame assembly positioned about the front end of the tread assembly. The A-frame assembly includes an inclination support connected to a front end of the tread assembly by hinges for varying inclination of the tread assembly. The inclination support is driven by a motor configured to rotate the inclination support about such that the inclination support vertically displaces the front end of the tread assembly thereby varying the inclination of the tread assembly. The A-frame assembly includes intermediate and front supports hinged to each other at upper ends thereof. The tread assembly is rotatable to a generally vertical orientation for storage. In the stored position, the spacing between front and intermediate supports is reduced, further facilitating storage. The A-frame assembly can further include a handle assembly having upper portion having handles and a lower portion in motive relation to the tread assembly such that variation in inclination corresponds to vertical displacement of the handle assembly.

Although the invention has been disclosed in detail with reference only to the preferred embodiments, those skilled in the art will appreciate that various other embodiments of treadmills can be provided without departing from the scope of the invention. Accordingly, the invention is defined only by the claims set forth below.

What is claimed is:

1. A foldable treadmill, comprising:

a tread assembly having front and rear ends and spaced-apart longitudinal sides extending therebetween; and an A-frame assembly positioned about the front end of the tread assembly, including a front support having an upper end and a lower end that serves as a floor contact, an intermediate support having an upper end hinged to the front support and a lower end that serves as a floor contact, an inclination support having a first end hinged with respect to the front support, thereby defining a first axis of rotation generally parallel with a lateral axis of the tread assembly, and a second end hinged to the front end of the tread assembly, thereby defining a second axis of rotation generally parallel with the lateral axis of the tread assembly, and an intermediate constraint having a first portion operatively attached to the intermediate support and a second portion operatively attached to structure spaced from the intermediate support;

wherein the inclination support is rotatable about the first axis of rotation such that the second end of the inclination support vertically displaces the front end of the tread assembly thereby varying the inclination of the tread assembly, and the tread assembly is rotatable about the second axis of rotation to a generally vertical orientation.

2. A foldable treadmill as defined in claim 1, wherein the A-frame assembly further includes a vertical constraint extending between upper ends of the front and intermediate supports and configured to restrict relative vertical displacement of the upper ends of the front and intermediate supports such that the both upper ends vertically displace about the same distance during a reorientation of the tread assembly.

3. A foldable treadmill as defined in claim 1, wherein the A-frame assembly further includes a handle assembly having an upper portion having handles and a lower portion attached to the inclination support or to the front end of the tread assembly such that rotation of the inclination support about the first axis of rotation causes the handle assembly to vertically displace.

4. A foldable treadmill as defined in claim 1, further comprising a motor configured to rotate the inclination support about the first axis of rotation such that the second end of the inclination support vertically displaces the front end of the tread assembly thereby varying the inclination of the tread assembly.

5. A foldable treadmill as defined in claim 1, wherein either the first or the second portion of the intermediate constraint is slidably attached to its prescribed structure.

6. A foldable treadmill as defined in claim 1, wherein the front support defines an elongated aperture, and the A-frame further includes a handle assembly including an upper portion having handles and a lower portion slidably disposed in the aperture of the front support.

7. A foldable treadmill as defined in claim 1, wherein the intermediate support includes two upstanding legs, each disposed on a corresponding longitudinal side of the tread assembly; further comprising a second intermediate constraint, wherein the first and second intermediate constraints are each slidably attached to a corresponding leg of the intermediate support and attached to the corresponding longitudinal side of the tread assembly.

8. A foldable treadmill as defined in claim 7, wherein the front support includes two upstanding legs spaced apart with one another and a reinforcement extending therebetween, each leg positioned behind and generally aligned with a corresponding upstanding leg of the intermediate support.

9. A foldable treadmill as defined in claim 8, wherein the A-frame assembly further includes two vertical constraints, each extending between upper ends of corresponding legs of the front and intermediate supports, the vertical constraints configured to restrict relative vertical displacement of the upper ends of the front and intermediate supports such that the both upper ends vertically displace about the same distance during a reorientation of the tread assembly.

10. A foldable treadmill as defined in claim 9, wherein the A-frame assembly further includes a handle assembly having upper portion having hand supports and a lower portion attached to the inclination support or the front end of the tread assembly such that rotation of the inclination support about the first axis of rotation causes the handle assembly to vertically displace.

11. A foldable treadmill as defined in claim 10, wherein the vertical constraints are slidably attached to the handle assembly.

12. A foldable treadmill, comprising:

a tread assembly having front and rear ends and spaced-apart longitudinal sides extending therebetween;

an A-frame assembly positioned about the front end of the tread assembly, including a front support having an upper end and a lower end that serves as a floor contact, an intermediate support having an upper end hinged to the front support and a lower end that serves as a floor contact, an inclination support having a first end hinged with respect to the front support, thereby defining a first axis of rotation generally parallel with a lateral axis of the tread assembly, and a second end hinged to the front end of the tread assembly, thereby defining a second axis of rotation generally parallel with the lateral axis of the tread assembly, a vertical constraint extending between the upper ends of the front and intermediate supports and configured to restrict relative vertical displacement of the upper ends of the front and intermediate supports such that the both upper ends vertically displace about the same distance during a reorientation of the tread assembly, an intermediate constraint having a first portion operatively attached to the intermediate support and a second portion operatively attached to structure spaced from the intermediate support, and a handle assembly having upper portion having handles and a lower portion attached to the inclination support or to the front end of the tread assembly such that rotation of the inclination support about the first axis of rotation causes the handle assembly to vertically displace; and a motor in motive contact with the inclination support and configured to rotate the inclination support about the first axis of rotation such that the second end of the inclination support vertically displaces the front end of the tread assembly thereby varying the inclination of the tread assembly; wherein the tread assembly is rotatable about the second axis of rotation to a generally vertical orientation.

13. A foldable treadmill as defined in claim 12, wherein either the first or the second portion of the intermediate constraint is slidably attached to its prescribed structure.

14. A foldable treadmill as defined in claim 12, wherein the intermediate support includes two upstanding legs, each disposed on a corresponding longitudinal side of the tread assembly; further comprising a second intermediate constraint, wherein the first and second intermediate constraints are each slidably attached to a corresponding leg of the intermediate support and attached to the corresponding longitudinal side of the tread assembly.

15. A foldable treadmill as defined in claim 14, wherein the front support includes two upstanding legs spaced apart with one another and a reinforcement extending therebetween, each leg positioned behind and generally aligned with a corresponding upstanding leg of the intermediate support.

16. A foldable treadmill as defined in claim 15, wherein the A-frame assembly includes a second vertical constraint, each the vertical constraints extending between upper ends of corresponding legs of the front and intermediate supports, the vertical constraints slidably attached to the handle assembly.

17. A foldable treadmill, comprising:

a tread assembly having front and rear ends and spaced-apart longitudinal sides extending therebetween;

an A-frame assembly positioned about the front end of the tread assembly, including a front support having an upper end and a lower end that serves as a floor contact, the front support defining an elongated aperture, an intermediate support having an upper end hinged to the front support and a lower end that serves as a floor contact, an inclination support having a first end hinged with respect to the front support, thereby defining a first axis of rotation generally parallel with a lateral axis of the tread assembly, and a second end hinged to the front end of the tread assembly, thereby defining a second axis of rotation generally parallel with the lateral axis of the tread assembly, an intermediate constraint having a first portion operatively attached to the intermediate support and a second portion operatively attached to structure spaced from the intermediate support, and a handle assembly including a upper portion having handles and a lower portion slidably disposed in the aperture of the front support; and a motor in motive contact with the inclination support and configured to rotate the inclination support about the first axis of rotation such that the second end of the inclination support vertically displaces the front end of the tread assembly thereby varying the inclination of the tread assembly; wherein the tread assembly is rotatable about the second axis of rotation to a generally vertical orientation.

18. A foldable treadmill as defined in claim 17, wherein the A-frame assembly further includes a link in motive contact with the handle assembly such that movement caused by the motor vertically displaces the handle assembly.

19. A foldable treadmill as defined in claim 17, wherein either the first or the second portion of the intermediate constraint is slidably attached to its prescribed structure.

20. A foldable treadmill as defined in claim 17, wherein the intermediate support includes two upstanding legs, each disposed on a corresponding longitudinal side of the tread assembly; further comprising a second intermediate constraint, wherein the first and second intermediate constraints are each slidably attached to a corresponding leg of the intermediate support and attached to the corresponding longitudinal side of the tread assembly.

21. A foldable treadmill as defined in claim 17, wherein the front support includes two upstanding legs spaced apart from one another and a reinforcement extending therebetween, each leg defining an elongated aperture for receiving corresponding legs of the handle assembly.

22. A foldable treadmill as defined in claim 21, wherein the A-frame further includes two links in motive contact with the handle assembly such that movement caused by the motor will vertically displace the handle assembly, each link attached to a corresponding leg of the handle assembly through a slot defined in the corresponding leg of the front support.

* * * * *